US005676100A

United States Patent [19]

Dam et al.

[11] Patent Number: 5,676,100

[45] Date of Patent: Oct. 14, 1997

[54] GLOW PLUG ASSEMBLY

[75] Inventors: Chuong Q. Dam; Kerry A. DelVecchio; Robert L. Miller, all of Peoria; Kenneth J. Suda, Edelstein, all of Ill.

[73] Assignee: Caterpillar Inc., Peoria, Ill.

[21] Appl. No.: 706,203

[22] Filed: Aug. 30, 1996

[51] Int. Cl.[6] ..... F02B 9/08

[52] U.S. Cl. ..... 123/145 A

[58] Field of Search ..... 123/145 A, 145 R; 219/270, 552, 553, 554; 252/518, 520; 361/264, 265, 266

[56] References Cited

U.S. PATENT DOCUMENTS

| | | | |
|---|---|---|---|
| 4,206,725 | 6/1980 | Jenkel et al. | 123/32 |
| 4,358,666 | 11/1982 | Taylor | 219/330 |
| 4,359,977 | 11/1982 | Spemer et al. | 123/145 |
| 4,418,661 | 12/1983 | Esper et al. | 123/145 |
| 4,548,172 | 10/1985 | Bailey | 123/298 |
| 4,598,676 | 7/1986 | Ito et al. | 123/145 |
| 4,634,837 | 1/1987 | Ito et al. | 219/270 |
| 4,661,686 | 4/1987 | Yokoi et al. | 219/270 |
| 4,721,081 | 1/1988 | Krauja et al. | 123/298 |
| 4,725,711 | 2/1988 | Minegishi et al. | 219/270 |
| 4,786,781 | 11/1988 | Nozaki et al. | 219/270 |
| 5,118,921 | 6/1992 | Aota | 219/270 |
| 5,130,517 | 7/1992 | Schmid et al. | 219/270 |
| 5,132,516 | 7/1992 | Hatanaka et al. | 123/145 A |
| 5,251,589 | 10/1993 | Duba et al. | 123/145 A |
| 5,304,778 | 4/1994 | Dasgupta | 219/270 |
| 5,319,180 | 6/1994 | Locher et al. | 219/270 |
| 5,589,091 | 12/1996 | Muller | 219/270 |

*Primary Examiner*—Raymond A. Nelli
*Attorney, Agent, or Firm*—Alan J. Hickman

[57] ABSTRACT

A glow plug assembly having a shield integrally connected to a housing is disposed in and retained in a bore in a cylinder head by a clamp connected to the cylinder head. A stop surface connected to said housing is engageable with the cylinder head and establishes the location of a heating element second end in the combustion chamber. The clamp maintains the stop against the head and the orientation of the shield angled second end relative to the combustion chamber. The heating element is connected to the housing by a spacer and the housing is sealed with a filler material which blocks the transfer of fluid through the housing. The filler material maintains the housing from passing fluid between the first and second housing ends, minimizes the vibration of the electrical conductors and conducts the heat out of the glow plug.

20 Claims, 3 Drawing Sheets

BEST MODE FOR CARRYING OUT THE INVENTION

Figure 1:
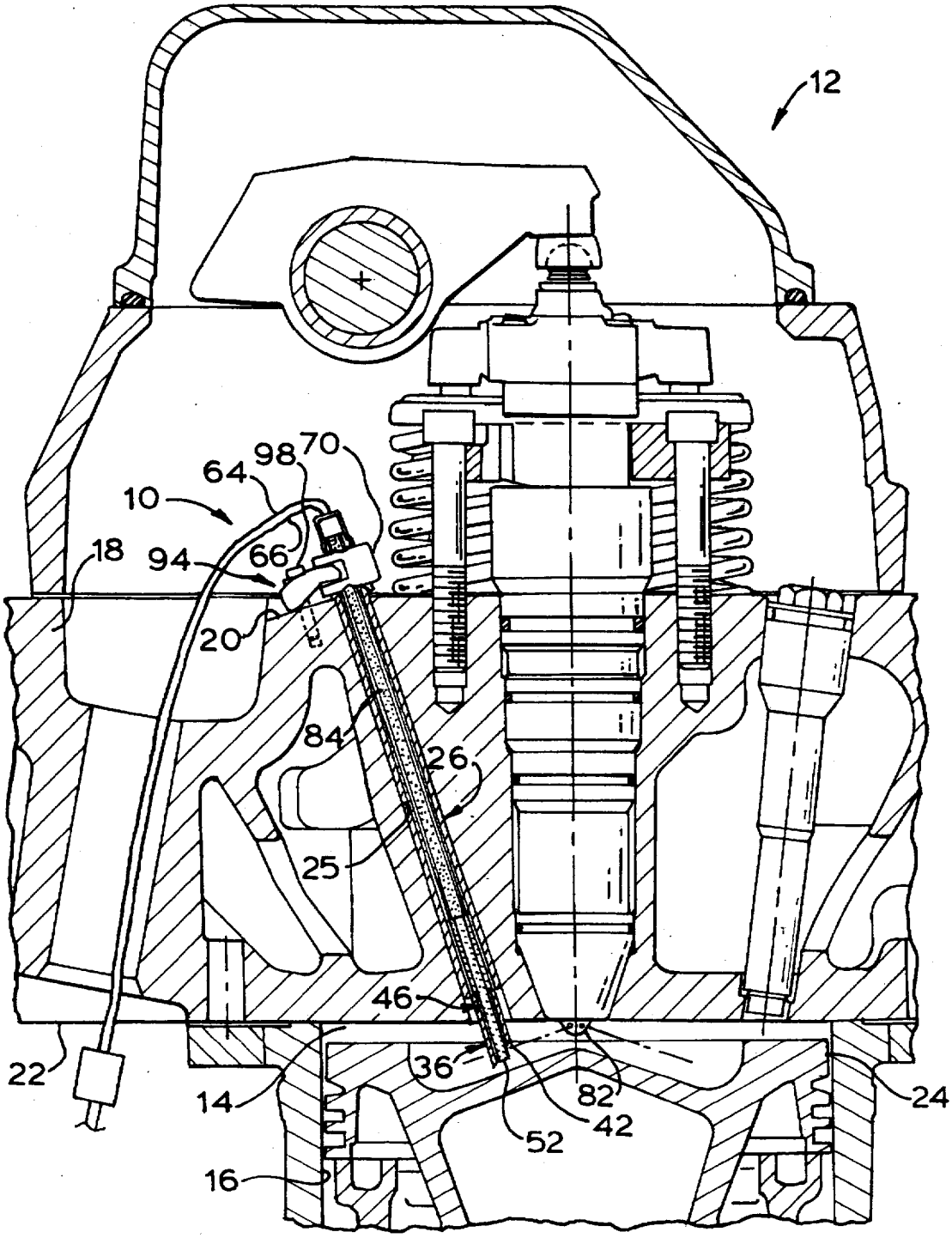
FIG. 1 is a diagrammatic cross-sectional view of an embodiment of the present invention showing a portion of an internal combustion engine and a glow plug assembly.

With reference to the drawings, and particularly FIG. 1, a glow plug assembly 10 for an internal combustion engine 12 has a combustion chamber 14 defined by a cylinder 16, a cylinder head 18 having first and second spaced sides 20,22, and a piston 24 disposed in the cylinder 16 and slidably movable in the cylinder 16 between top and bottom dead center positions relative to the second side 22 in a conventional manner. The cylinder head 18 has a bore 25 which is disposed at an angle relative to the longitudinal axis of the cylinder 16. The bore 25 is open at the first and second sides 20,22 of the cylinder head 18 and open to the combustion chamber 14.

Figure 2:
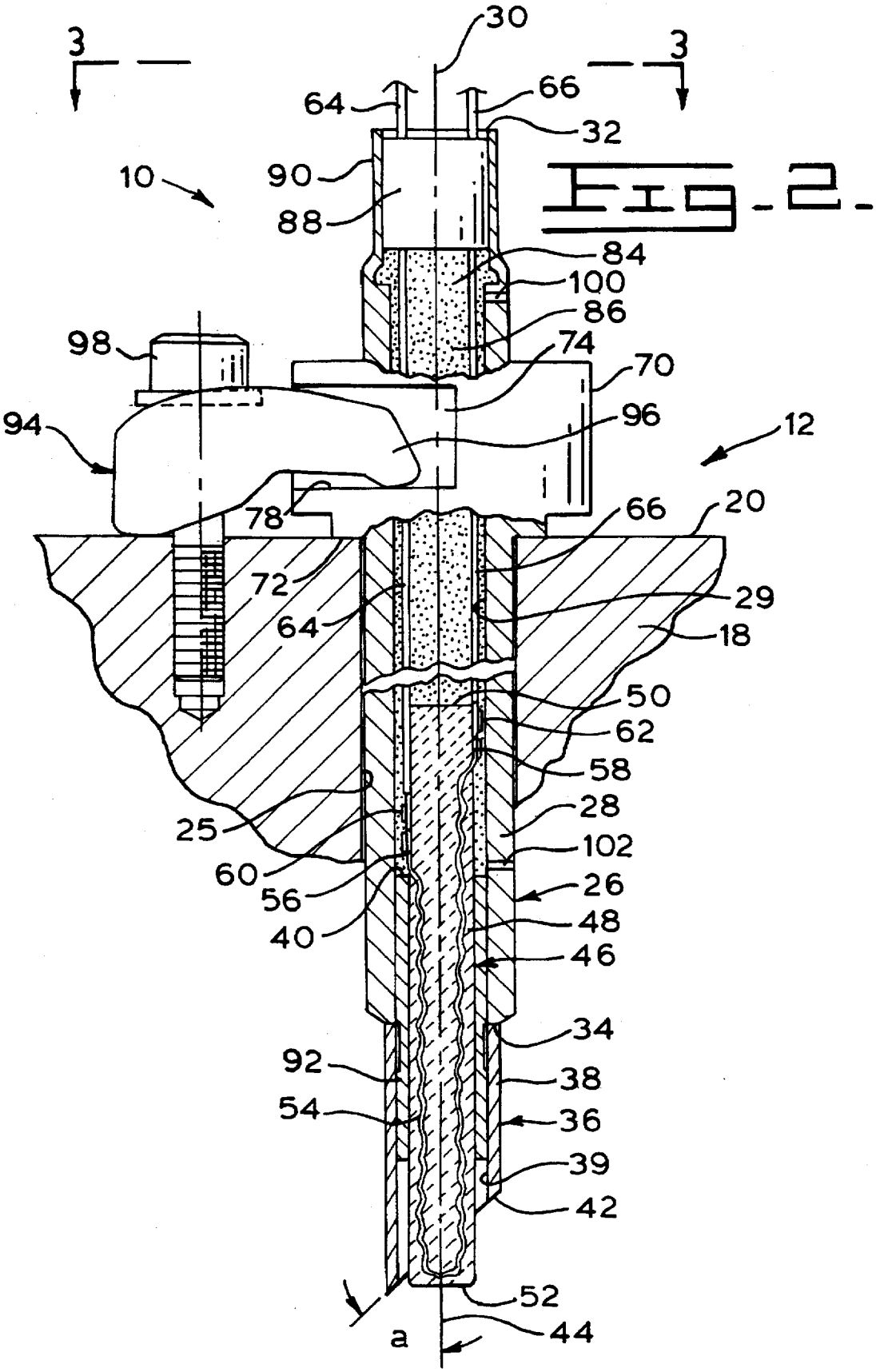
FIG. 2 is an enlarged diagrammatic cross-section view of the glow plug assembly of FIG. 1.
Figure 3:
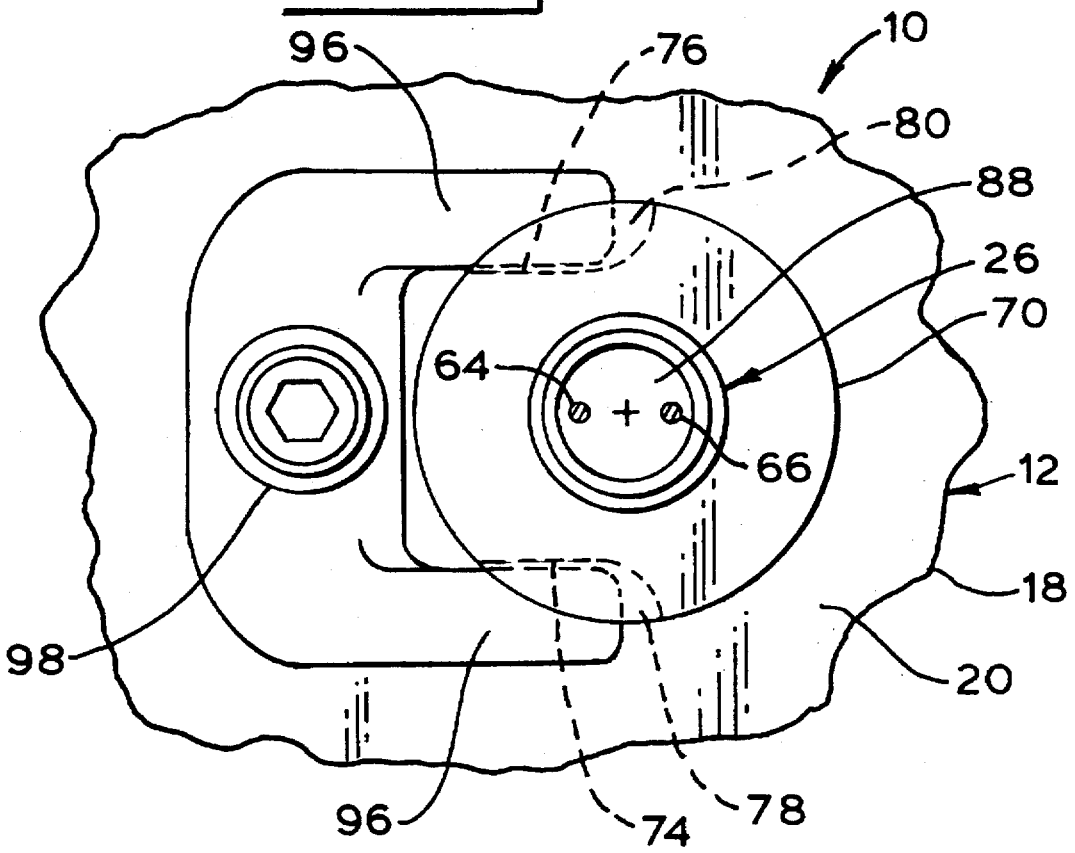
FIG. 3 is a diagrammatic view of the glow plug assembly taken along lines 3—3 of FIG. 2.
Figure 3:
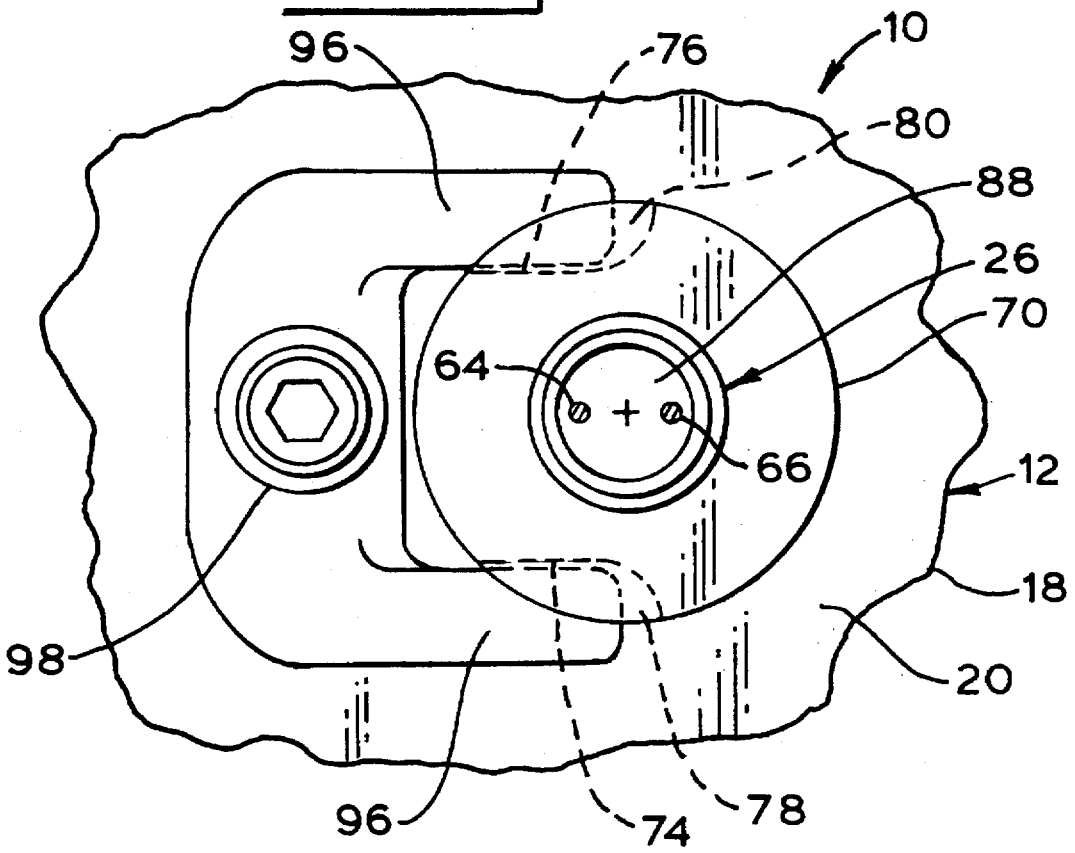

As best seen in FIG. 2, the glow plug assembly 10 has a housing 26, an elongated tubular body portion 28 having an aperture 29, a longitudinal axis 30, and first and second opposite ends 32,34. The housing 26 is made from a high temperature steel material and disposed in the bore 25.

A shield 36 is connected to the housing 26 and extends coaxially from the housing 26 second end 34. A shield 36 has a tubular body portion 38, an aperture 39, and first and second opposite ends 40,42. The shield second end 42 is spaced axially outwardly from the housing second end 34 and is cut at a pre selected acute angle "a" relative to the longitudinal axis 44 of the shield 36. The shield 36 is made from a high temperature resistant material such as an Inconel steel. The shield 36 is disposed in the combustion chamber 14 and maintains a combustible air/fuel mixture 14 in close proximity to a heating element 46. The shield 36 also assists in preventing incoming air from excessively cooling the heating element 46.

The heating element 46 is disposed in the apertures 29,39 of the housing 26 and shield 36. The heating element 46 has a cylindrical body portion 48, first and second opposite ends 50,52, and a heating filament 54 or the like contained within the cylindrical body portion 48. The heating element second end 52 is located adjacent the shield second end 42 and exposed to gasses in the combustion chamber 14 by way of the angled opening at the shield second end 42. The heating element is preferably made from a ceramic base material of appropriate composition. To improve combustion characteristics and increase glow plug life ceramic base material may be coated, such as with an oxide and/or a catalyst.

The heating filament 54 has first and second ends 56,58 which exit the periphery of the cylindrical body portion 48 at a location nearest the heating element first end 46. A pair of connectors 60,62, of a conventional commercially available type, connects the first and second heating filament ends 56,58 to a pair of conductors 64,66. The connectors 60,62 are affixed to the cylindrical body portion, such as by banding, to reduce the potential of wire flexing and to provide a quality connection. The pair of electrical conductors 64,66, which are located between the first and second ends of the housing, exit the housing first end. The pair of electrical conductors 64,66, rather than a single electrical conductor, provides an electrical current path from a source of electrical energy (not shown) to the heating filament 54 and a positive ground conductor for the heating filament 54.

A flange 70 is connected to the tubular body portion 28 of the housing 26. The flange 70 has a stop surface 72, a pair of spaced apart flat portions 74,76, and a pair of surfaces 78,80. The pair of flat portions 74,76 are substantially parallel to the longitudinal axis 30 of the housing 26 and the pair of surfaces 78,80 are transversely oriented relative to the longitudinal axis 30. The stop surface 72 is substantially normal to the longitudinal axis 30 and spaced a preselected longitudinal distance from the second end 52 of the heating element 46. As will later be discussed, this controlled length determines the amount of projection of the heating element 46 into the combustion chamber and the distance between the second end 52 and the second side 22 of the cylinder head 18. The pair of flat portions 74,76 are positioned at preselected locations relative to the second end of the shield 36 so that the orientation of the angled second end 42 is fixed relative to the flat portions 74,76. As will be later discussed, this facilitates accurate orientation of the glow plug assembly relative to a fuel injector nozzle 82 (FIG. 1) located in the combustion chamber 14.

A filler material 84 such as a high temperature silicon material having high thermoconductivity and electrical resistivity is disposed in the housing 26 and seals an area 86 within the aperture 39 of the housing 26 located between the first end 46 of the heating element 46 and the housing 26. The filler material 84 maintains the housing 26 from passing fluid through the aperture 29 and between the first and second housing ends 32,34. The filler material is disposed about the pair of electrical conductors 64,66 and maintains the electrical conductors from movement within the aperture 29 and reduces the potential for conductor failure caused by vibration, excessive heat, chemical breakdown and the like.

The filler material 84 is injected into the aperture 29 of the housing 26 by any suitable injection process. A pair of spaced apart injection passages 100,102 radially disposed at spaced apart locations along the housing 26, opens into the aperture 29. These passages 100,102 facilitate filling of the aperture 29 between the first end 50 of the heating element 46 and the first end 32 of the housing 26.

The glow plug assembly 10 includes a seal 88 of any suitable elastomeric material composition is disposed in the aperture 29 at a location adjacent the first end 32 of the housing 26. The seal 88 is engaged with the housing 26 and the pair of electrical conductors 64,66. The seal 88 seals the first end 32 and provides stress relief to the electrical conductors 64,66 exiting the first end at a juncture of engagement between the seal 88 and the electrical conductors 64,66.

The housing 26 has a first end portion 90 of reduced cross-sectional thickness located adjacent to and terminating at the housing first end. The first end portion 90 has a reduced cross-sectional thickness from the remainder of the tubular body 28. The first end portion 90 is crimped to engage and retain the elastomeric seal at the location adjacent the second end 34.

A spacer 92 having a tubular shape and a predetermined length is disposed about and connected to the heating element 46 in any suitable manner such as by furnace brazing. The spacer 92 is disposed in the apertures 29,39 of the housing 26 and shield 36 and facilitates connection of the shield 36 to the housing 26. The spacer 92 is connected to the housing by brazing, pressing or other suitable mechanical connecting methods. The shield 36 is connected to the spacer 92 by crimping, pressing, brazing or other suitable mechanical connecting methods.

A clamp 94 is connected to the cylinder head 18 at the first side 20. The bifurcated end portion 96 of the clamp 94 is engaged with the pair of spaced apart flat portions 74,76 and the pair of surfaces 78,80 and urges the stop surface 72 into engagement with the first side 20 of the cylinder head 18. The clamp 94 maintains the second end 42 of the shield 36 at a preselected orientation relative to the combustion chamber 14 and from rotation about the longitudinal axis 30 so that the fuel directed by the fuel injector nozzle 82 is collected by the shield for combustion by the heating element 46. The clamp 94 also maintains the second end 52 of the heating element 46 at a preselected distance from the second side 22.

A threaded fastener 98 screw threadably connected to said cylinder head 18 at a radial location spaced from the housing 26 engages the clamp and the first side 20 of the cylinder head 18 and selectively urges the clamp 94 into forcible engagement with the pair of surfaces 78,80. This forcible engagement maintains the stop surface 72 against the first side 20 of the head 18 and the preselected distance between the second end 52 of the heating element and the second side 22 of the head 18.

INDUSTRIAL APPLICABILITY

With reference to the drawings and in operation, the glow plug assembly 10, including the shield 36 and heating element 46, is serviceable as a unit and therefore the shield 36 is changed each time the glow plug assembly is changed. This eliminates the potential to not replace the shield when needed.

The clamp bifurcated end portion 96, through engagement with the pair of flat portions 74,76, easily and accurately positions the shield second end 42 so that the second end 42 is oriented at the predetermined proper angular position relative to the combustion chamber 14 and the fuel injection nozzle 82. As shown in FIG. 1, the angled second end 42 is open to face the fuel injection nozzle. As a result, the fuel/air mixture in the combustion chamber is maintained in close proximity to the heating element 46 by the shield 36. This promotes ignition of the fuel/air mixture in close proximity to the heating element 46 and easier and more complete combustion of the fuel/air mixture in the combustion chamber 14.

The bifurcated end portion of the clamp 94, through forcible engagement with the pair of surfaces 78,80, urges the stop surface 72 of the flange 70 against the first side 20 of the cylinder head 18 and maintains the second end 52 of the heating element 46 in at the preselected distance from the second side 22 of the cylinder head 18. Is should be noted that this also maintains the shield second end 42, at a location of greatest distance on the shield second end 42 from the second end 34 of the housing 26, a preselected distance from the second side 22 of the cylinder head 18. Thus, the second ends 42 and 52 are maintained at a preselected spaced close distance from the piston 24 at the top dead center position of movement of the piston 24. This eliminates the potential for interference with the piston 24 and improves combustion characteristics.

The clamp 94 is maintained relative to the flange 70 by way of the treaded fastener 98. This facilitates ease of installation and removal of the glow plug assembly 10 and ensures that an adequate amount of force is available at the levered clamp bifurcated end portion to maintain the glow plug at the installed position during the combustion process and operation of the engine. The amount of force applied is a function of the torque applied to the threaded fastener 98 and the radial distance between the bifurcated end portion 96 and the threaded fastener 98.

The combustion chamber 14 undergoes various environmental changes during 4 cycle operation. Air and fuel are drawn into the chamber 14 during the intake stroke, compressed during the compression stroke until combustion near top dead center occurs, expanded during the power stroke and exhausted during the exhaust stroke. The glow plug assembly 10 is exposed to temperature, pressure and state of gas changes that occur in the combustion chamber 14. The instant glow plug assembly 10 is capable of providing long life in such an environment. The long life filler material 84 assists in this regard by blocking the inadvertent transfer of gasses in the combustion chamber 14 from passing through the aperture 29 in the housing 26 and thereby preventing premature failure of the conductors 64,66. The connection of the shield 36 to the housing 26, in the manner discussed above, also assists in providing a glow plug assembly 10 with an extended life.

Other aspects, objects and advantages of the present invention can be obtained from a study of the drawings, the disclosure and the appended claims.

We claim:

1. A glow plug assembly for an internal combustion engine, comprising:

a housing having an elongated tubular body portion, first and second opposite ends, and an aperture opening at the first and second ends;

a shield having a tubular body portion, first and second opposite ends, and an aperture opening at the first and second ends of the shield, said shield being connected to and extending coaxially from the second end of said housing;

a heating element having first and second spaced ends and being disposed in the aperture of said shield and housing, said second end of the heating element being adjacent the second end of the shield;

a flange having a stop surface and being connected to said tubular body portion; said stop surface being at a preselected axial location spaced from the second end of the heating element;

a pair of electrical conductors connected to said heating element at a location between the first and second ends of the housing and extending from the aperture of the housing first end; and a filler material disposed in the aperture of the housing and sealing an area within the aperture of the housing located between the first ends of the heating element and housing, said filler material maintaining the housing from passing fluid between the first and second housing ends.

2. A glow plug assembly, as set forth in claim 1, wherein said filler material is disposed about the pair of electrical conductors and maintains the electrical conductors from movement within the aperture of said housing.

3. A glow plug assembly, as set forth in claim 2, wherein said filler material includes a high temperature silicone material.

4. A glow plug assembly, as set forth in claim 2, including an elastomeric seal disposed in the aperture of said housing at a location adjacent the housing first end, said seal being engaged with the housing, the pair of electrical conductors and providing stress relief to the electrical conductors at a juncture of engagement with the electrical conductors.

5. A glow plug assembly, as set forth in claim 4, wherein said housing has a first end portion located adjacent the first end, said first end portion having a reduced cross-sectional thickness, said first end portion being crimped to engage and retain the elastomeric seal at said location adjacent the second end.

6. A glow plug assembly, as set forth in claim 1, wherein the shield has a longitudinal axis and the flange has a pair of spaced apart flat portions, said second end of the shield being at a predetermined acute angle relative to the longitudinal axis and being oriented in a preselected direction relative to said pair of spaced apart flat portions.

7. A glow plug assembly, as set forth in claim 6, wherein said flange has a pair of surfaces, and including a clamp engagable with said pair surfaces.

8. A glow plug assembly, as set forth in claim 7, wherein said clamp has a bifurcated portion engagable with the pair of surfaces of said flange and said pair of flat portions, said clamp being adapted to maintain the shield from rotational and longitudinal movement.

9. A glow plug assembly, as set forth in claim 1, wherein said shield includes a tubular spacer disposed about said heating element and in the apertures of said housing and shield.

10. A glow plug assembly, as set forth in claim 9, wherein said spacer connects the heating element and the shield to the housing.

11. A glow plug assembly, as set forth in claim 9, wherein said spacer is connected to said heating element by brazing.

12. A glow plug assembly, as set forth in claim 11, wherein said spacer is mechanically connected to said shield and housing by pressing.

13. A glow plug assembly, as set forth in claim 11, wherein said shield being connected to said spacer by crimping and said spacer being connected to said housing by brazing.

14. A glow plug assembly, as set forth in claim 10, wherein said heating element includes a ceramic base material having an oxide coating.

15. A glow plug assembly for an internal combustion engine having a combustion chamber defined by a cylinder, a cylinder head having first and second sides and a piston, said cylinder head having a bore disposed therethrough and opening at said first and second sides, comprising:

a housing having an elongated tubular body, a longitudinal axis, and first and second opposite ends;

a shield having a tubular body portion, first and second opposite ends, and being connected to and extending coaxially from said housing, said shield second end being spaced axially outwardly from the second end of said housing and at a preselected acute angle relative to a longitudinal axis of the shield;

a heating element having first and second opposite ends and being disposed in the housing, said heating element second end being located adjacent the shield second end;

a flange having a stop surface, a pair of spaced apart flat portions, and a pair of surfaces, said flange being connected to the housing, said pair of flat portions being substantially parallel relative to the longitudinal axis of said housing and said pair of surfaces being transversely oriented relative to the longitudinal axis of said housing, said stop surface being spaced a preselected longitudinal distance from the second end of the heating element and said pair of flat portions being positioned at preselected locations relative to the second end portion of the shield;

a pair of electrical conductors connected to said heating element at a location between the first and second ends of the housing and extending from the housing first end;

a filler material disposed in the housing and sealing an area within the housing located between the first end of the heating element and housing, said filler material maintaining the housing from passing fluid between the first and second housing ends;

said housing being disposed in the bore of the cylinder head and said second end of the shield and heating element being located in the combustion chamber; and a clamp having a bifurcated end portion and being connected to said cylinder head, said bifurcated end portion being engaged with the pair of spaced apart flat portions and the pair of surfaces and urging the stop surface into engagement with the first surface of the cylinder head, said clamp maintaining the second end of the shield at a preselected orientation relative to the combustion chamber and the second end of the heating element at a preselected distance from the second side.

16. A glow plug assembly, as set forth in claim 15, wherein said housing and shield each have an aperture, and said shield includes a tubular spacer disposed about said heating element and in the apertures of said housing and shield.

17. A glow plug assembly, as set forth in claim 16, wherein said spacer connects the heating element and the shield to the housing.

18. A glow plug assembly, as set forth in claim 15, wherein said housing has an aperture, and said filler material is disposed about the pair of electrical conductors and maintains the electrical conductors from movement within the aperture of said housing.

19. A glow plug assembly, as set forth in claim 18, wherein said filler material includes a high temperature silicone material.

20. A glow plug assembly, as set forth in claim 15 including a threaded fastener screw threadably connected to said cylinder head at a radial location spaced from said housing, said threaded fastener engaging said clamp and urging said clamp into forcible engagement with said pair of surfaces.

* * * * *